US008276750B2

(12) United States Patent
Biondi et al.

(10) Patent No.: US 8,276,750 B2
(45) Date of Patent: Oct. 2, 2012

(54) PACKAGE OF CIGARETTES HAVING AN INNER PACKAGE WITH A STIFFENER

(75) Inventors: Andrea Biondi, Bologna (IT); Luca Cavazza, Bologna (IT); Michele Squarzoni, Ferrara (IT)

(73) Assignee: G.D Societa' per Azioni, Bologna (IT)

( * ) Notice: Subject to any disclaimer, the term of this patent is extended or adjusted under 35 U.S.C. 154(b) by 59 days.

(21) Appl. No.: 12/866,632

(22) PCT Filed: Feb. 6, 2009

(86) PCT No.: PCT/EP2009/051387

§ 371 (c)(1),
(2), (4) Date: Dec. 10, 2010

(87) PCT Pub. No.: WO2009/098297

PCT Pub. Date: Aug. 13, 2009

(65) Prior Publication Data

US 2011/0084120 A1 Apr. 14, 2011

(30) Foreign Application Priority Data

Feb. 7, 2008 (IT) ..... BO2008A0080

(51) Int. Cl.
*B65D 85/10* (2006.01)

(52) U.S. Cl. ..... 206/259; 206/271; 229/87.13

(58) Field of Classification Search ..... 206/271, 206/273, 259, 242, 260; 229/87.13
See application file for complete search history.

(56) References Cited

U.S. PATENT DOCUMENTS

| | | | | |
|---|---|---|---|---|
| 2,322,654 | A | 6/1943 | Moore | |
| 2,377,358 | A | 6/1945 | Moore | |
| 2,859,865 | A * | 11/1958 | Williams | 206/259 |
| 2,910,175 | A * | 10/1959 | Williams | 206/259 |
| 3,948,389 | A * | 4/1976 | Molins et al. | 206/245 |
| 3,999,655 | A | 12/1976 | Molins et al. | |
| 4,949,841 | A | 8/1990 | Focke et al. | |
| 5,992,621 | A | 11/1999 | Grant et al. | |
| 2005/0155878 | A1 * | 7/2005 | Pham | 206/259 |
| 2005/0224374 | A1 * | 10/2005 | Petrucci et al. | 206/242 |
| 2007/0193896 | A1 * | 8/2007 | Tanbo et al. | 206/259 |

FOREIGN PATENT DOCUMENTS

| | | |
|---|---|---|
| DE | 2503421 | 7/1975 |
| DE | 4330006 | 3/1995 |
| EP | 0330969 | 9/1989 |
| GB | 501778 | 3/1939 |

OTHER PUBLICATIONS

International Search Report and Written Opinion for corresponding International Application No. PCT/EP2009/051387, dated Jul. 20, 2009 (12 pp.).

* cited by examiner

*Primary Examiner* — Jacob K Ackun
(74) *Attorney, Agent, or Firm* — Marshall, Gerstein & Borun LLP

(57) ABSTRACT

A package of cigarettes, having: a group of cigarettes; an inner package enclosing the group of cigarettes and made from a sheet of wrapping folded about the group of cigarettes; and a U-shaped stiffener made of rigid material and located inside the inner package, contacting the group of cigarettes; the sheet of wrapping has two flaps which are superimposed and heat sealed to each other at a rear wall or front wall of the group of cigarettes defined by the cylindrical lateral walls of the cigarettes.

8 Claims, 7 Drawing Sheets

PACKAGE OF CIGARETTES HAVING AN INNER PACKAGE WITH A STIFFENER

CROSS-REFERENCE TO RELATED APPLICATIONS

This is the U.S. national phase of International Application No. PCT/EP2009/051387, filed Feb. 6, 2009, which claims the benefit of Italian Patent Application No. BO2008A000080, filed Feb. 7, 2008.

TECHNICAL FIELD

The present invention relates to a package of cigarettes having an inner package with a stiffener.

In the following description, reference is made, for the sake of simplicity, to a rigid, hinged-lid packet of cigarettes, purely by way of a non-limiting example.

BACKGROUND ART

Rigid, hinged-lid packets of cigarettes are currently the most widely marketed, by being easy to produce, practical and easy to use, and by effectively protecting the cigarettes inside.

A rigid, hinged-lid packet of cigarettes comprises an inner package defined by a group of cigarettes wrapped in a sheet of foil inner wrapping; and a rigid outer package housing the inner package. The outer package comprises a cup-shaped container housing the group of cigarettes and having an open top end; and a cup-shaped lid hinged to the container along a hinge to rotate, with respect to the container, between an open and a closed position opening and closing the open end respectively.

Tobacco is highly sensitive to environment. That is, in contact with the atmosphere, its organic characteristics tend to vary alongside variations in humidity (by losing or absorbing too much moisture) or due to evaporation of the volatile substances with which the tobacco is impregnated (especially in the case of aromatic cigarettes treated with spices such as cloves). To preserve the tobacco, packets of cigarettes are therefore cellophane-wrapped, i.e. wrapped in a heat-sealed overwrapping of airtight plastic material. This, however, may not always be sufficient to fully preserve the tobacco in the packet, especially if the packet is consumed some time after manufacture. Moreover, when the packet is unsealed, the overwrapping is removed at least partly, thus exposing the tobacco to the atmosphere, and, if the cigarettes are not consumed soon after the packet is unsealed, the organic characteristics of the remaining cigarettes may deteriorate visibly.

In an attempt to eliminate this drawback, rigid packets of cigarettes have been proposed in which the inner package is airtight, is heat sealed, and comprises a sheet of airtight inner wrapping.

One problem of rigid packets of cigarettes, in which the inner package comprises a sheet of airtight wrapping, is that, once some of the cigarettes are removed, the inner package tends to collapse, thus making it difficult to withdraw the remaining cigarettes. Moreover, when heat sealing the superimposed portions of the sheet of airtight inner wrapping, the cigarettes are subjected to mechanical stress that may result in local deformation and/or tobacco fallout, and to thermal stress that may deteriorate the tobacco locally.

To solve this problem, it has been proposed, e.g. in MOLINS LTD U.S. Pat. No. 3,999,655 and HAUNI WERKE KOERBER & CO KG Patent DE4330006, to insert a rigid collar, comprising a cardboard stiffener, inside the inner package and about the group of cigarettes to maintain the correct shape of the inner package and protect the cigarettes when folding and heat sealing the sheet of airtight inner wrapping. However, placing and folding a rigid collar of the type currently marketed about the group of cigarettes before folding the sheet of inner wrapping about the group of cigarettes is extremely complex on a standard packing machine, so producing this type of packet calls for a special packing machine that is much more expensive than an equivalent standard packing machine.

Disclosure of the Invention

It is an object of the present invention to provide a package of cigarettes designed to eliminate the above drawbacks, and which, at the same time, is cheap and easy to produce, and can be produced on a substantially standard packing machine.

According to the present invention, there is provided a package of cigarettes as claimed in the accompanying Claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 3:
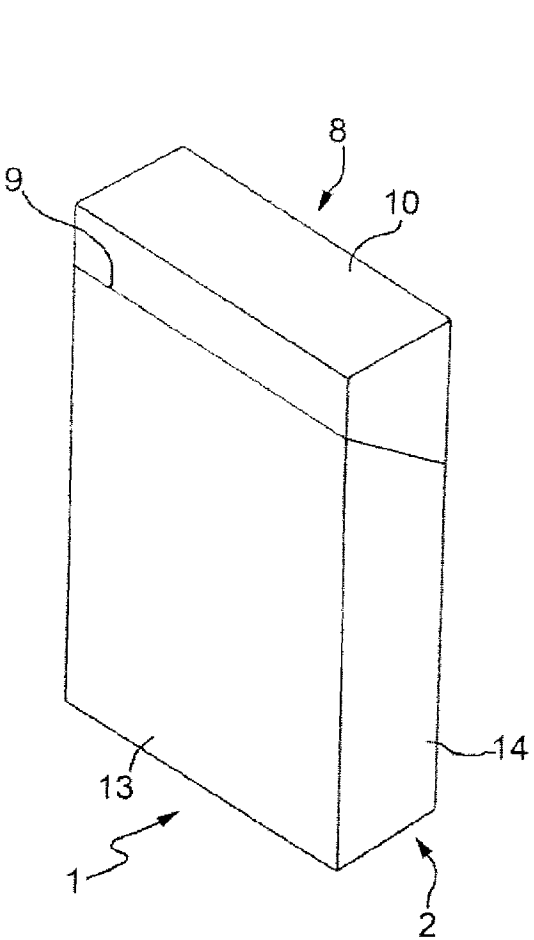
FIG. 3 shows a rear view in perspective of the FIG. 1 packet of cigarettes in a closed configuration.
Figure 2:
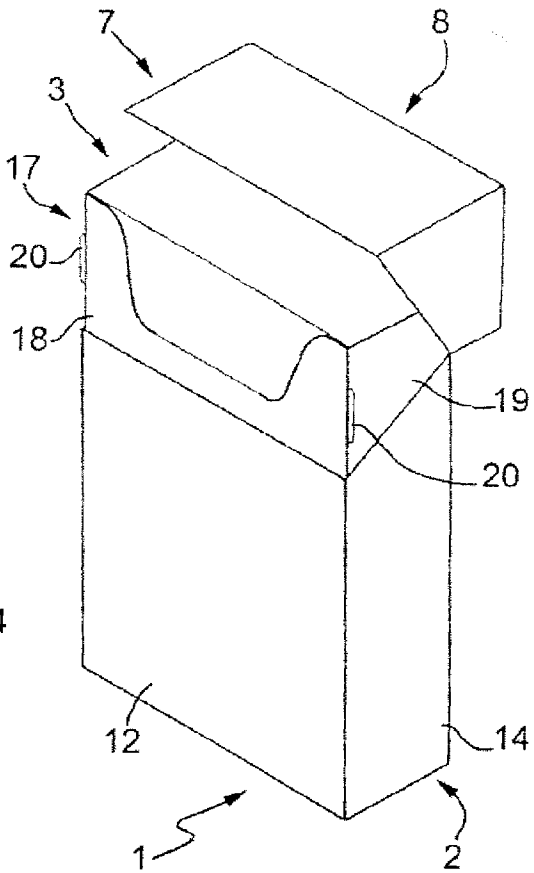
FIG. 2 shows a front view in perspective of the FIG. 1 packet of cigarettes in an open configuration.
Figure 1:
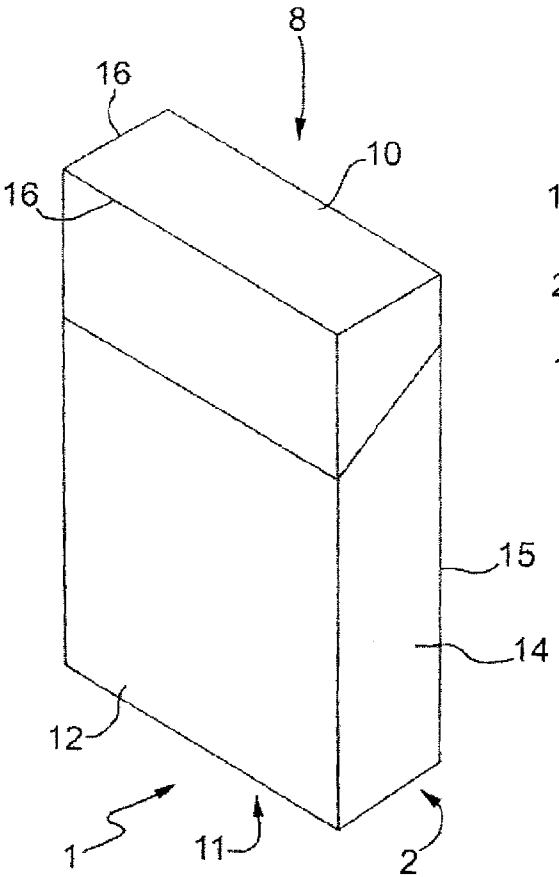
FIG. 1 shows a front view in perspective of a packet of cigarettes in accordance with the present invention and in a closed configuration.
Figure 4:
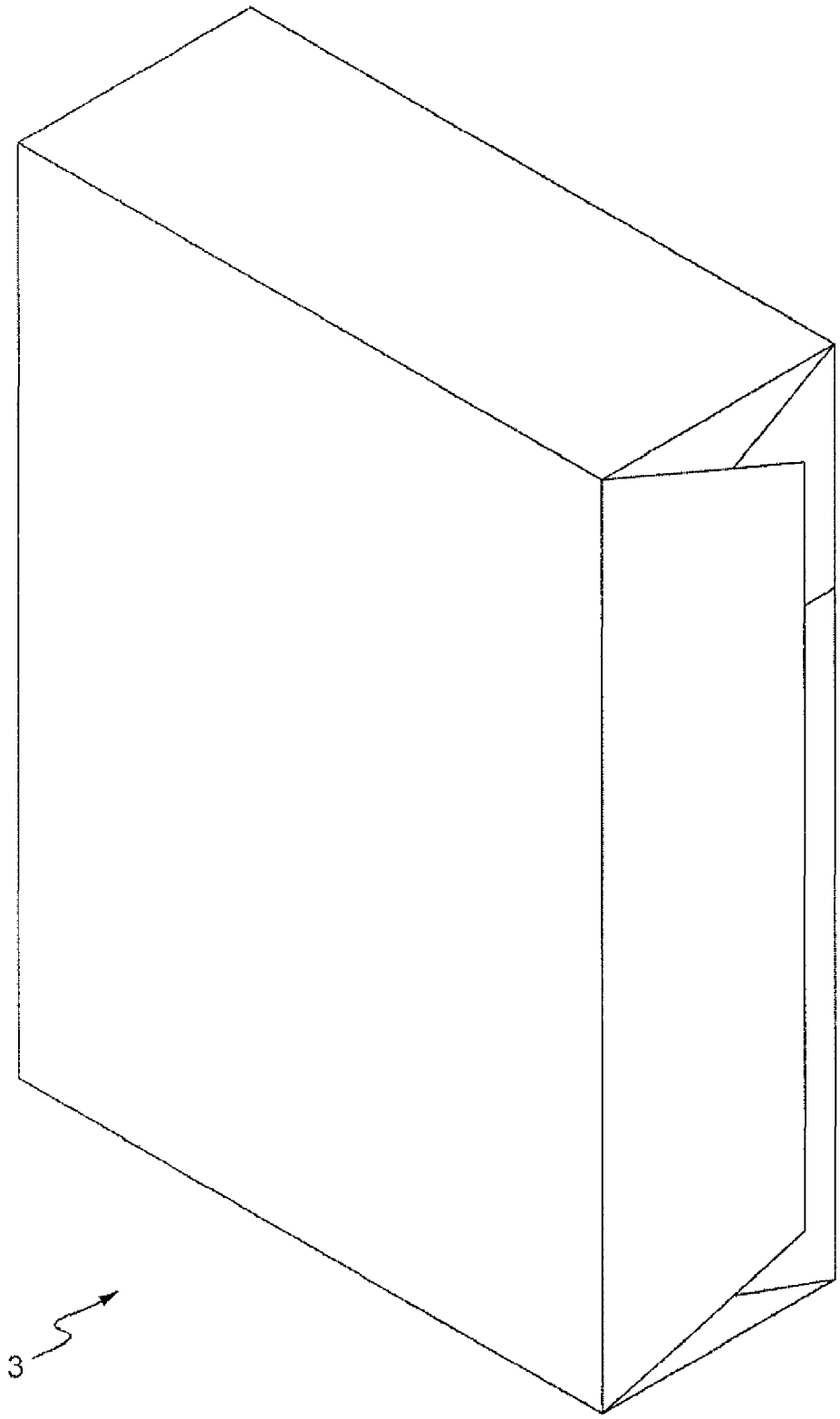
FIG. 4 shows a front view in perspective of an inner package of the FIG. 1 packet.
Figure 5:
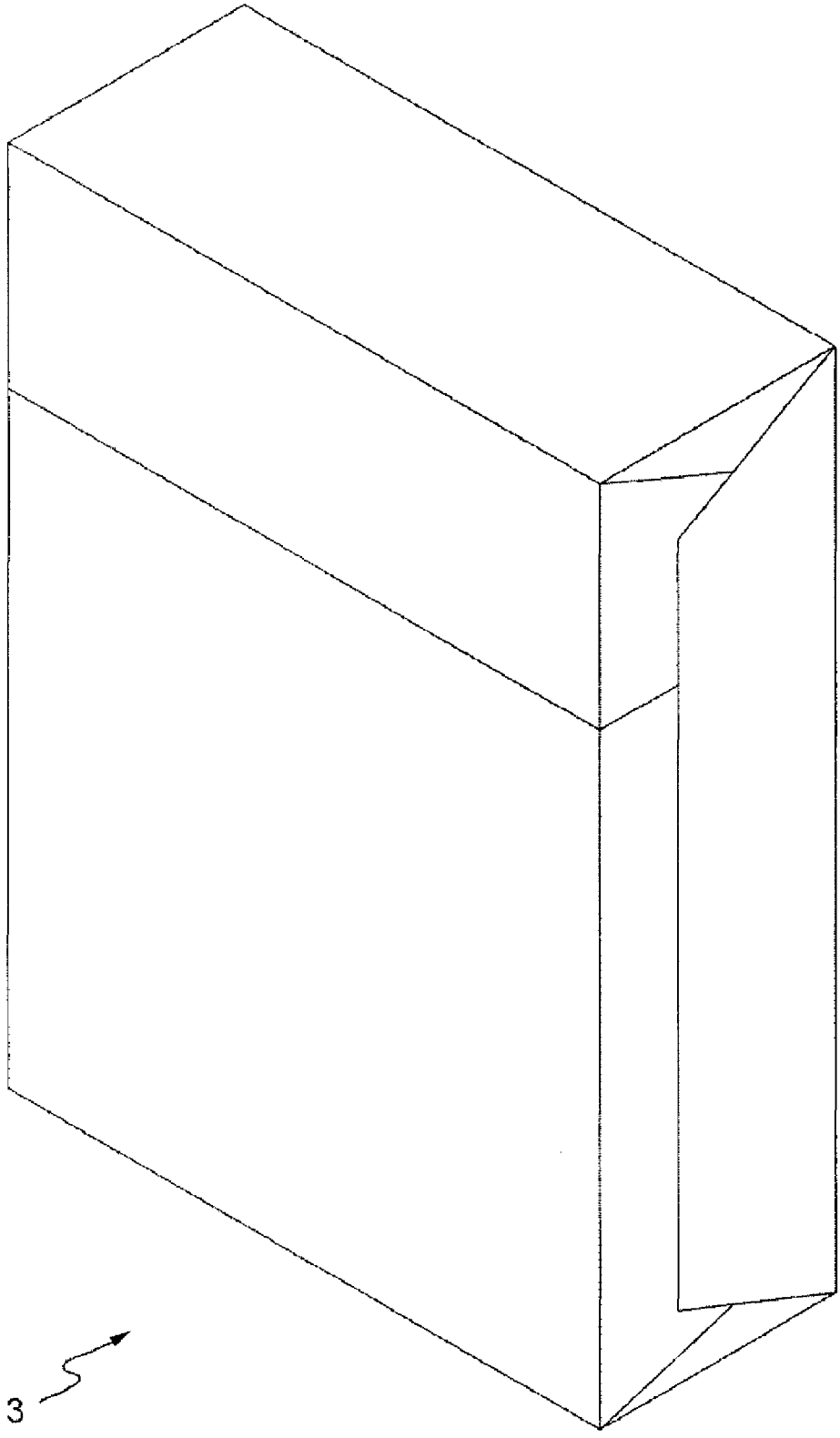
FIG. 5 shows a rear view in perspective of the FIG. 4 inner package.

Number 1 in FIGS. 1, 2 and 3 indicates as a whole a rigid packet of cigarettes comprising a cup-shaped outer container 2 made of rigid cardboard; and an inner package 3 housed inside container 2 and enclosing a parallelepiped-shaped group 4 of cigarettes.

Outer container 2 has an open top end 7, and a cup-shaped lid 8 hinged to container 2 along a hinge 9 to rotate, with respect to container 2, between an open position (FIG. 2) and a closed position (FIGS. 1 and 3) opening and closing open top end 7 respectively.

When lid 8 is in the closed position, outer container 2 is in the form of a rectangular parallelepiped comprising a top wall 10 and a bottom wall 11 opposite and parallel to each other; two opposite parallel major lateral walls 12 and 13; and two opposite parallel minor lateral walls 14. More specifically, one major lateral wall 12 defines a front wall 12 of outer container 2, and the other major lateral wall 13 defines a rear wall 13 of outer container 2. Four longitudinal edges 15 are defined between lateral walls 14 and front and rear walls 12, 13; and eight transverse edges 16 are defined between top and bottom walls 10, 11 and front, rear, and lateral walls 12, 13, 14.

Packet 1 also comprises a collar 17, which is folded into a U and fixed (normally glued) inside outer container 2, so as to project partly outwards of open top end 7 and engage a corresponding inner surface of lid 8 when lid 8 is in the closed position. Collar 17 is made of rigid cardboard, and comprises a front wall 18 contacting front wall 12 of outer container 2; and two lateral walls 19 located on opposite sides of front wall and contacting minor lateral walls 14 of outer container 2.

In a preferred embodiment, collar 17 has two projections 20 which project laterally to interferentially engage the lateral walls of lid 8 to hold lid 8 in the closed position.

Figure 7:
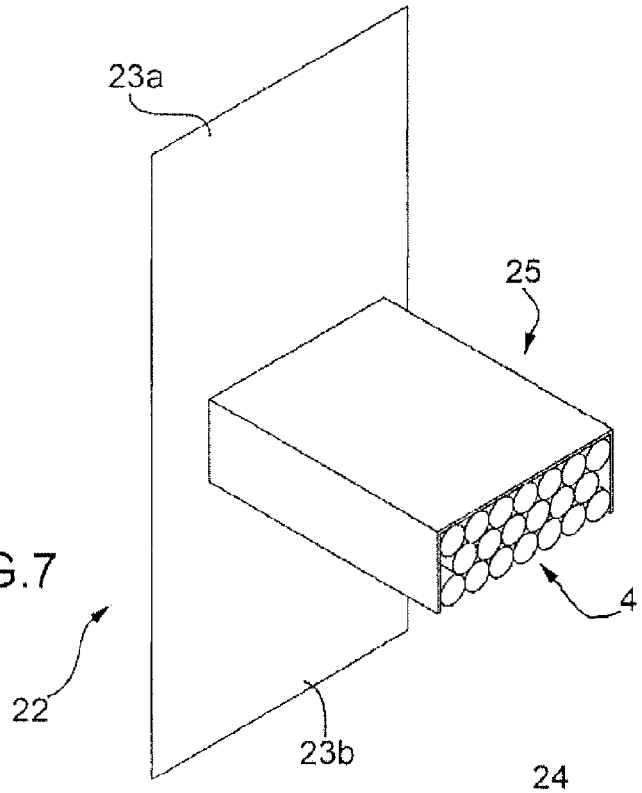
FIGS. 7, 8 and 9 show, in perspective, a folding sequence by which to fold a sheet of inner wrapping about a group of cigarettes to form the FIG. 4 inner package.
Figure 8:
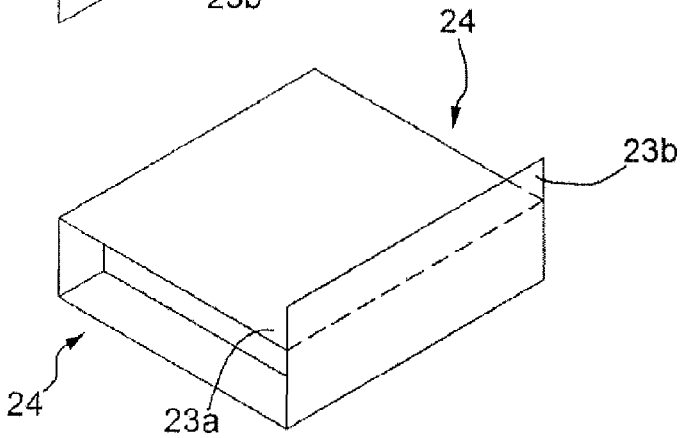

As shown in FIGS. 7 and 8, inner package 3 is formed by folding a rectangular sheet 22 of wrapping, which is made of airtight, heat-seal plastic material, and is folded directly about group 4 of cigarettes and in direct contact with the cigarettes. Once sheet 22 of wrapping is folded about group 4 of cigarettes to form inner package 3, the shape of inner package 3 is stabilized by heat sealing the superimposed portions of sheet 22 of wrapping.

Figure 9:
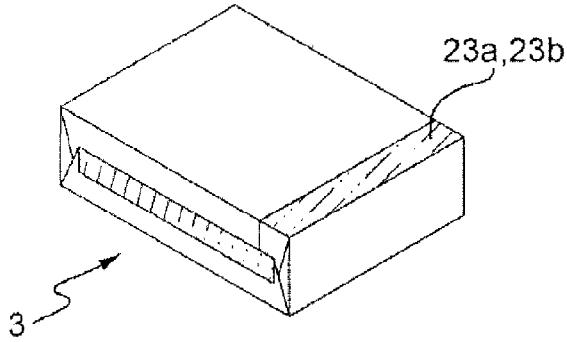

The way in which sheet 22 of wrapping is folded about group 4 of cigarettes is shown in FIGS. 7, 8 and 9, and comprises first folding sheet 22 of wrapping into a U about group 4 of cigarettes to cover a top wall of group 4 of cigarettes defined by the filters of the cigarettes in group 4, and the front and rear walls of group 4 of cigarettes defined by the cylindrical lateral walls of the cigarettes in group 4. More specifically, sheet 22 of wrapping is folded asymmetrically about group 4 of cigarettes to define two flaps 23 of different lengths: a short flap 23*a* resting entirely on (i.e. not projecting from) the rear wall of group 4 of cigarettes; and a long flap 23*b* projecting from the front wall of group 4 of cigarettes. At this point, as shown in FIG. 8, sheet 22 of wrapping is folded further about group 4 of cigarettes to form a tubular wrapping with two open ends 24 (only one shown in FIG. 8) at the minor lateral walls of group 4 of cigarettes. More specifically, to form the tubular wrapping, the long flap 23*b* is folded over the bottom wall of group 4 defined by the tips of the cigarettes in group 4, and onto the rear wall of group 4 to overlap the short flap 23*a* folded previously. In other words, the short flap 23*a* initially rests on the rear wall of group 4 of cigarettes, and the long flap 23*b* is folded onto the rear wall of group 4 of cigarettes to overlap short flap 23*a*.

The tubular wrapping is stabilized by transversely heat sealing the superimposed portions of the two flaps 23. It is important to note that the position of the superimposed portions of the two flaps 23 on the rear wall of group 4 of cigarettes (i.e. on the rear wall of inner package 3) can be moved up or down by adjusting the position of sheet 22 of wrapping with respect to group 4 of cigarettes.

Once the tubular wrapping is stabilized by heat sealing the superimposed portions of the two flaps 23, the folding of sheet 22 of wrapping about group 4 of cigarettes to form inner package 3 is completed by folding the two open ends 24 at the minor lateral walls of group 4 in known manner. Finally, inner package 3 is stabilized by two longitudinal heat seals (only one shown in FIG. 9) along the superimposed portions of sheet 22 of wrapping on the minor lateral walls of group 4 of cigarettes.

As shown in FIGS. 7, 8 and 9, the short flap 23*a* initially rests on the rear wall of group 4 of cigarettes, and the long flap 23*b* is folded onto the rear wall of group 4 of cigarettes to overlap short flap 23*a*, so the superimposed portions of the two flaps 23 are heat sealed to each other by pressing the two superimposed flaps 23 against the rear wall of group 4 of cigarettes. In the variation shown in FIGS. 10, 11 and 12, when forming the tubular wrapping, the two flaps are positioned perpendicular to the rear wall of group 4 of cigarettes, and are superimposed and heat sealed while still perpendicular to the rear wall of group 4 (FIG. 11); and the two superimposed, heat sealed flaps 23 are then folded together onto the rear wall of group 4. In this case, the two flaps 23 are heat sealed by a gripper, which, unlike the FIGS. 7, 8 and 9 embodiment, presses the two superimposed flaps 23 together without exerting any pressure on the rear wall of group 4 of cigarettes.

Figure 6:
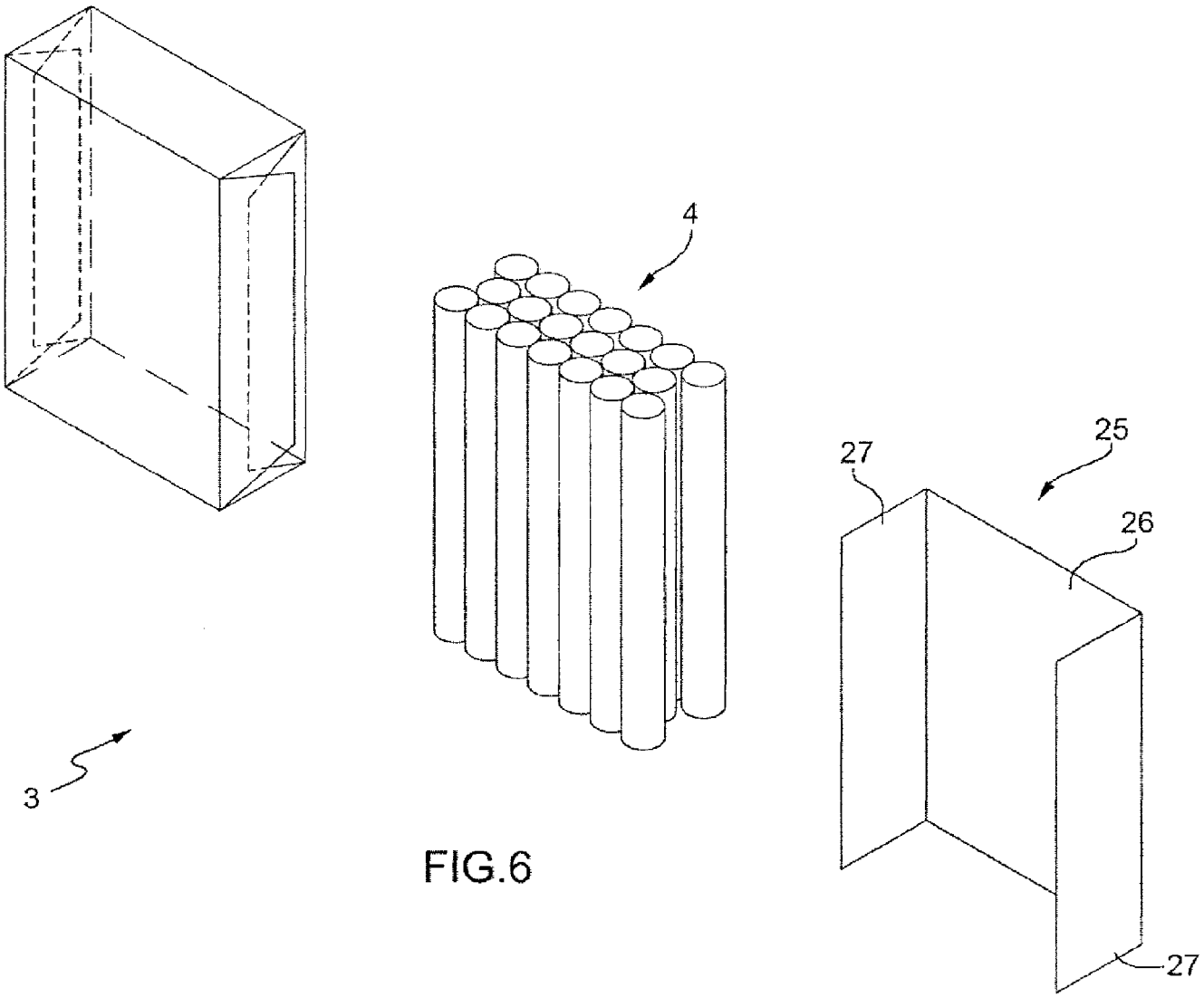
FIG. 6 shows an exploded view in perspective of the FIG. 4 inner package.

As shown in FIG. 6, inner package 3 comprises a U-shaped stiffener 25 made of rigid cardboard (the same type used for outer container 2 and collar 17) and located inside inner package 3, contacting group 4 of cigarettes. Stiffener 25 comprises a rectangular main wall 26, which is positioned contacting the rear wall defined by the cylindrical lateral walls of the cigarettes in group 4; and two lateral wings 27 connected to the long sides of main wall 26 and which are positioned contacting the minor lateral walls of group 4 defined by the cylindrical lateral walls of the cigarettes. When inner package 3 is housed inside outer container 2, main wall 26 of stiffener 25 is therefore located next to rear wall 13 of outer container 2, and lateral wings 27 of stiffener 25 are located next to minor lateral walls 14 of outer container 2.

In a variation not shown, each lateral wing 27 of stiffener 25 may also comprise a top appendix, which is folded onto the top wall of group 4 defined by the filters of the cigarettes, so that, when inner package 3 is housed inside outer container 2, the top appendixes are located next to top wall 10 of outer container 2.

Stiffener 25 serves to reinforce and stabilize the shape of inner package 3, and so prevent inner package 3 from collapsing when some of the cigarettes are removed, thus making it difficult to withdraw the remaining cigarettes. In addition, stiffener 25 also provides adequate mechanical protection of the cigarettes when folding sheet 22 of wrapping, adequate mechanical and thermal protection of the cigarettes when heat sealing the superimposed portions of sheet 22 of wrapping, and adequate mechanical protection of the cigarettes when handling inner package 3.

Figure 14:
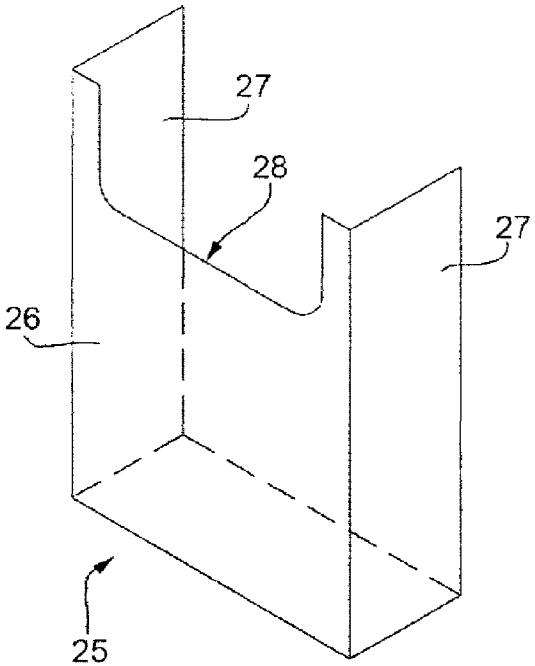
Figure 13:
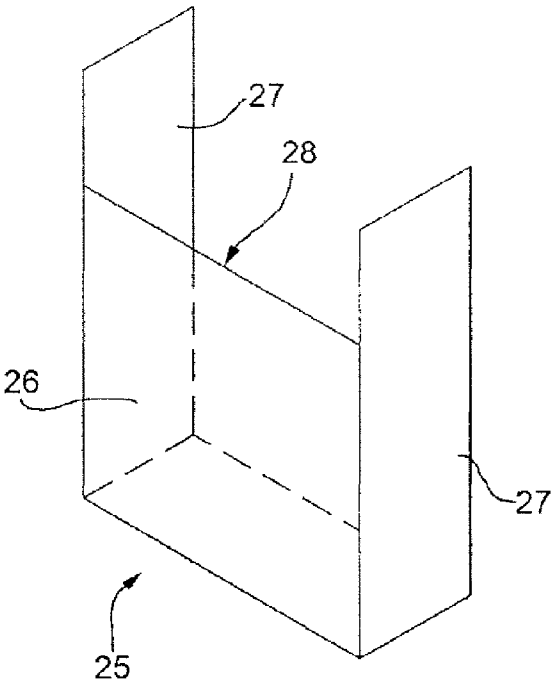

In the FIG. 1-9 embodiment, stiffener 25 comprises a rectangular main wall 26 positioned contacting the rear wall of group 4 of cigarettes, and the two flaps 23 of sheet 22 of wrapping are superimposed and heat sealed on the rear wall of group 4. In a variation shown in FIGS. 13 and 14, the main wall 26 of stiffener 25 is positioned contacting the front wall of group 4 of cigarettes, and the two flaps of sheet 22 of wrapping are superimposed and heat sealed on the front wall of group 4. As shown in FIGS. 13 and 14, the main wall 26 of stiffener 25 has a top window 28 to prevent main wall 26 from interfering with withdrawal of the cigarettes. The only difference between the FIG. 13 and FIG. 14 embodiments is in the different shape of top window 28.

As stated, two functions of stiffener 25 are to provide adequate mechanical protection of the cigarettes when folding sheet 22 of wrapping, and adequate mechanical and thermal protection of the cigarettes when heat sealing the superimposed portions of sheet 22 of wrapping, so main wall 26 of stiffener 25 must obviously be positioned contacting the rear wall of group 4 when the two flaps 23 of sheet 22 of wrapping are superimposed and heat sealed on the rear wall of group 4, and must be positioned contacting the front wall of group 4 when the two flaps 23 of sheet 22 of wrapping are superimposed and heat sealed on the front wall of group 4.

Figure 15:
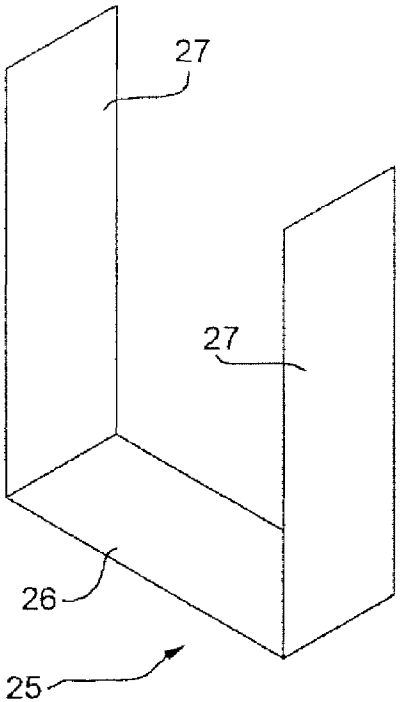
FIGS. 13, 14 and 15 show, in perspective, three variations of a stiffener of the FIG. 4 inner package.

In a variation shown in FIG. 15, stiffener 25 is designed so that main wall 26 of stiffener 25 is positioned contacting the bottom wall of group 4 defined by the tips of the cigarettes in group 4. In the FIG. 15 embodiment, main wall 26 of stiffener 25 is obviously much smaller than in FIGS. 6, 13 and 14, and lateral wings 27 of stiffener 25 are connected to the short sides of main wall 26 (i.e. along minor transverse edges), whereas, in the FIGS. 6, 13 and 14 embodiments, lateral wings 27 of stiffener 25 are connected to the long sides of main wall 26 (i.e. along longitudinal edges).

Figure 10:
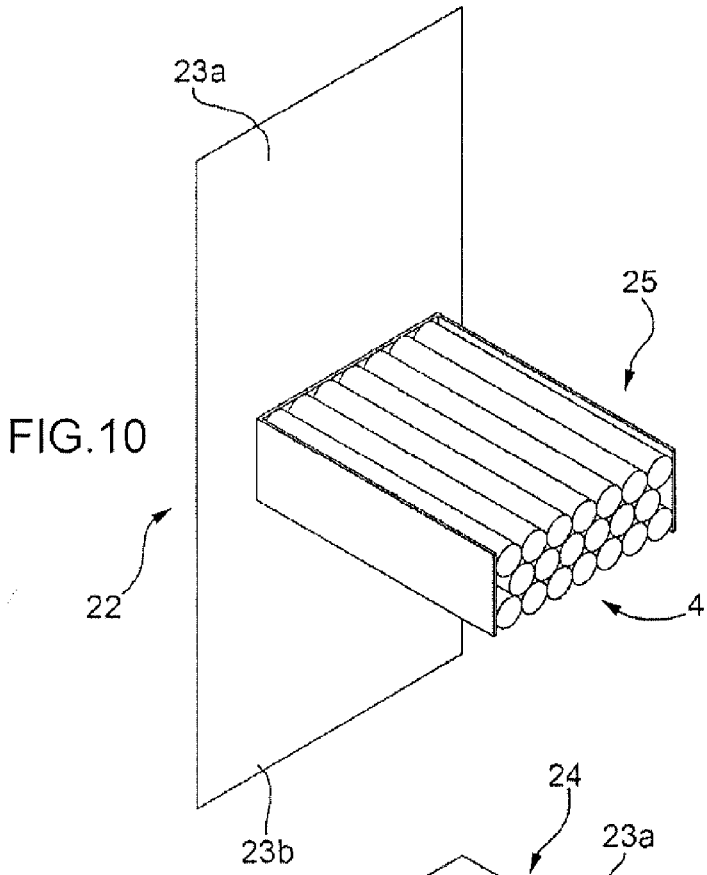
FIGS. 10, 11 and 12 show, in perspective, a different folding sequence by which to fold a sheet of inner wrapping about a group of cigarettes to form the FIG. 4 inner package.
Figure 11:
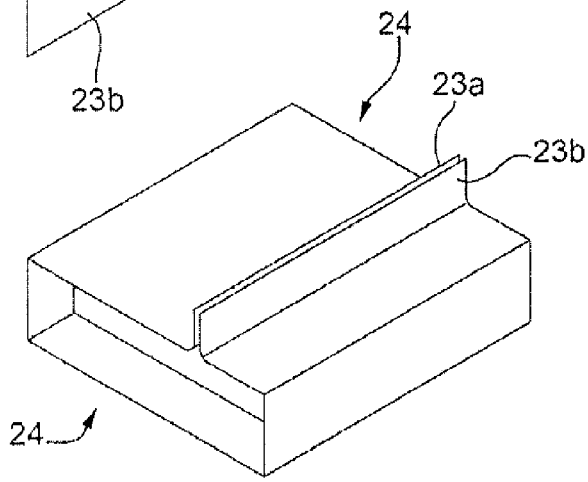
Figure 12:
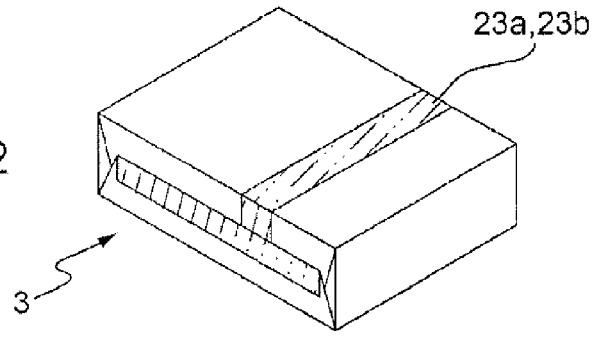

The FIG. 15 embodiment of stiffener 25 is preferably only used when folding sheet 22 of wrapping as shown in FIGS. 10, 11 and 12. That is, by providing no protection of the front and rear walls of group 4 of cigarettes, the FIG. 15 stiffener 25 is only suitable for the FIGS. 10, 11 and 12 method of folding sheet 22 of wrapping, which applies no pressure/heat on the front and rear walls of group 4.

In a different embodiment not shown, as opposed to an outer container 2 of rigid cardboard, packet 1 of cigarettes comprises a soft outer package partly enclosing inner package 3 and leaving at least a top wall of inner package 3 free. In a further embodiment not shown, packet 1 of cigarettes has no outer container 2, and is defined solely by inner package 3.

Inner package 3 as described has numerous advantages. In particular, it is cheap and easy to produce, by virtue of stiffener 25 being extremely easy to fold, even on a standard packing machine.

The invention claimed is:

1. A package of cigarettes, comprising:

a group (4) of cigarettes having a top wall, a bottom wall, a front wall, a rear wall and two minor lateral walls connecting the front and rear walls, the group (4) of cigarettes oriented longitudinally between the top and bottom walls;

a wrapping (3) enclosing the group (4) of cigarettes and made from a sheet (22) of wrapping folded about the group (4) of cigarettes; and a stiffener (25) made of rigid material and located inside the wrapping (3), contacting the group (4) of cigarettes;

wherein:

the sheet (22) of wrapping extends asymmetrically about the top wall of the group (4) of cigarettes to define two flaps: a short flap (23*a*) resting entirely on the rear wall or front wall of the group (4) of cigarettes, and a long flap (23*b*) extending also about the bottom wall of the group (4) of cigarettes onto the rear wall or front wall of the group (4) of cigarettes and superimposed over the short flap (23*a*);

the two superimposed flaps (23) are transversely heat sealed to each other at the rear wall or front wall of the group (4) of cigarettes; and the sheet (22) of wrapping is folded and heat sealed longitudinally at the minor lateral walls of the group (4) of cigarettes.

2. A package as claimed in claim 1, wherein the two flaps (23) are superimposed and heat sealed to each other against the rear wall or front wall of the group (4) of cigarettes.

3. A package as claimed in claim 1, wherein the two flaps (23) are positioned perpendicular to the rear wall or front wall of the group (4) of cigarettes to be superimposed and heat sealed to each other, and the two superimposed, heat sealed flaps (23) are then folded together onto the rear wall or front wall of the group (4) of cigarettes.

4. A package as claimed in claim 1, wherein the stiffener (25) is U-shaped, and comprises a rectangular main wall (26) which is positioned contacting the rear wall or front wall of the group (4) of cigarettes; and two lateral wings (27) connected to the long sides of the main wall (26) and positioned contacting minor lateral walls of the group (4) of cigarettes defined by the cylindrical lateral walls of the cigarettes.

5. A package as claimed in claim 4, wherein the main wall (26) of the stiffener (25) is positioned contacting the front wall of the group (4) of cigarettes, and comprises a top window (28).

6. A package as claimed in claim 1, wherein the stiffener (25) is U-shaped, and comprises a rectangular main wall (26) which is positioned contacting a bottom wall of the group (4) of cigarettes defined by the tips of the cigarettes in the group (4) of cigarettes; and two lateral wings (27) connected to the short sides of the main wall (26) and positioned contacting minor lateral walls of the group (4) of cigarettes defined by the cylindrical lateral walls of the cigarettes.

7. A package as claimed in claim 1, and comprising a rigid outer container (2) housing the wrapping (3).

8. A package as claimed in claim 7, wherein the rigid outer container (2) is cup-shaped, and has an open top end (7), and a cup-shaped lid (8) hinged to the outer container (2) along a hinge (9) to rotate, with respect to the outer container (2), between an open position and a closed position opening and closing the open top end (7) respectively.

* * * * *